US006129591A

United States Patent [19]

Czeschka

[11] Patent Number: 6,129,591

[45] Date of Patent: Oct. 10, 2000

[54] MULTIWAY CONNECTOR FOR BACKPLANES AND SLIDE-IN CARDS IN COMPACT PCI SYSTEMS

[75] Inventor: Franz Czeschka, Rechberghausen, Germany

[73] Assignee: ERNI Elektroapparate GmbH, Adelberg, Germany

[21] Appl. No.: 09/030,476

[22] Filed: Feb. 25, 1998

[30] Foreign Application Priority Data

Dec. 6, 1997 [DE] Germany ..... 297 21 401 U

[51] Int. Cl.[7] ..... H01R 13/64

[52] U.S. Cl. ..... 439/680; 439/491

[58] Field of Search ..... 439/488, 491, 439/59, 677, 680, 681

[56] References Cited

U.S. PATENT DOCUMENTS 4,227,762 10/1980 Scheiner .

4,784,614 11/1988 Sadigh-Behzadi ..... 439/488

5,147,226 9/1992 Kile ..... 439/680

5,441,426 8/1995 Boulais ..... 439/681

5,449,302 9/1995 Yarbrough et al. ..... 439/680

*Primary Examiner*—Khiem Nguyen

*Attorney, Agent, or Firm*—Friedrich Kueffner

[57] ABSTRACT

A multiway connector for backplanes and slide-in cards, for example, in so-called compact PCI systems, composed of two separate modules each arranged without spacing next to one another, wherein each of the modules has a mechanical coding piece for preventing incorrect insertions. At the two modules of the male multipoint connector resting against each other at end faces thereof as well as the modules of the female multipoint connector are constructed as a single-piece component of synthetic material.

5 Claims, 1 Drawing Sheet

MULTIWAY CONNECTOR FOR BACKPLANES AND SLIDE-IN CARDS IN COMPACT PCI SYSTEMS

BACKGROUND OF THE INVENTION

1. Field of the Invention

The present invention relates to a multiway connector for backplanes and slide-in cards, for example, in so-called compact PCI systems, composed of two separate modules each arranged without spacing next to one another, wherein each of the modules has a mechanical coding piece for preventing incorrect insertions.

2. Description of the Related Art

The demands made by industry for increasingly faster and more powerful bus systems has recently resulted in practice in the development of a PCI-bus multiway connector specifically for data-intensive applications in conventional 5.0-V-logic or also in the new 3.3-V-logic.

In the past, the slide-in cards as well as the so-called backplanes were equipped during the assembly in the conventional press-in technology with two separate male and female multipoint connectors each arranged without spacing next to one another and, in an additional work step, were provided with a mechanical coding piece for preventing system damage due to incorrect insertions. To be able to quickly optically differentiate the respective coding pairs of the male and female multipoint connector modules, in the compact piece PCI in question, conventional codings were used which were brilliant blue for conventional 5.0-V-logic and cadmium yellow for 3.3-V-logic.

SUMMARY OF THE INVENTION

Therefore, it is the primary object of the present invention to simplify the manufacturing processes and to reduce the assembly and storage costs in the manufacture of backplanes and slide-in cards for compact PCI systems.

In accordance with the present invention, at the two modules of the male multipoint connector resting against each other at end faces thereof as well as the modules of the female multipoint connector are constructed as a single-piece component of synthetic material.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
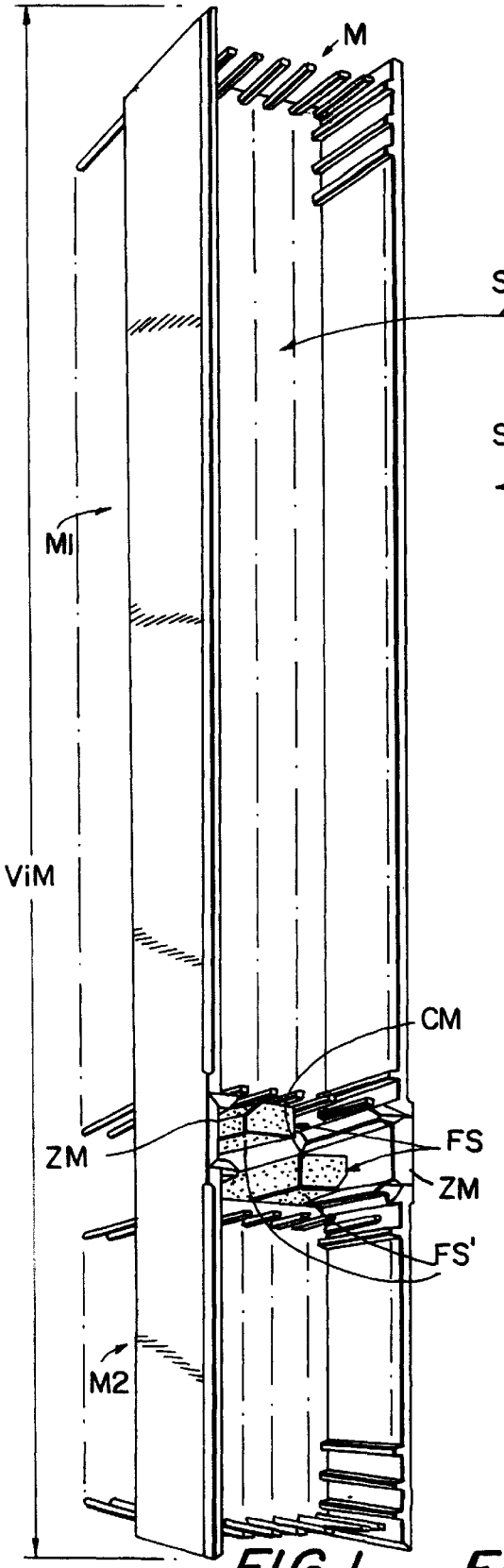
FIG. 1 is a perspective view of a male multipoint connector.
Figure 2:
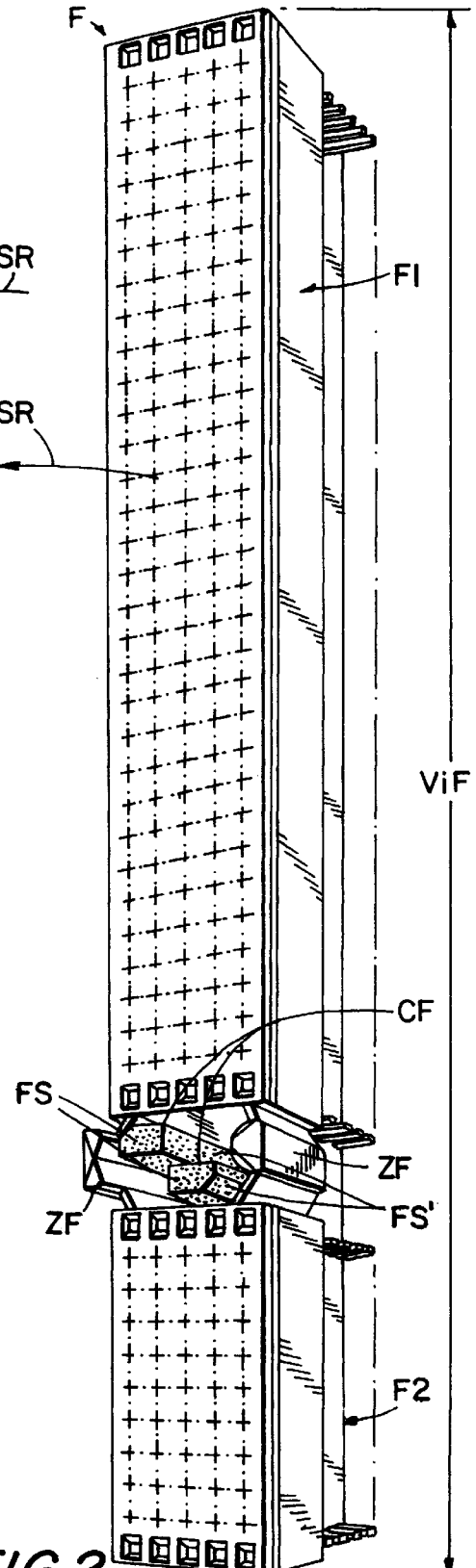
FIG. 2 is a perspective view of a corresponding female multipoint connector according to the present invention.

FIGS. 1 and 2 of the drawing show that, in accordance with the present invention, at least the two partial modules M1, M2 of the male multipoint connector M which rest against each other at end faces as well as the partial modules F1, F2 of the female multipoint connector F are constructed as single-piece components KF and KM of synthetic material.

In accordance with an advantageous feature, the male multipoint connector M as well as the female multipoint connector F including the respective coding parts CF and CM are manufactured as a single-piece injection molded component KF or KM. This configuration completely meets the object of the present invention, i.e., in the manufacture of backplanes and slide-in cards, for example, for compact PCI systems or also other or similar systems, the processing or manufacturing procedures are substantially simplified and, thus, assembly and storage costs are reduced.

In accordance with another embodiment of the present invention, at least the upper side of the coding parts CF and CM each have a color coating FS which identifies the respective system, i.e., 5.0-V-logic or 3.3-V-logic. Alternatively, it is also conceivable to manufacture the single-piece components KF with CF and KM with CM entirely of a synthetic material having a color, i.e., brilliant blue or cadmium yellow in accordance with the logic being used.

In accordance with another alternative embodiment, the coding parts CF and CM may in their totality be composed of a different or differently colored material FS' as compared to the corresponding male and female multipoint connectors M1, M2 and F1, F2, wherein the coding parts and the multipoint connectors form single-piece components KM and KF. For manufacturing the embodiment mentioned last, the so-called multi-component injection molding method can be used in which, for example, already otherwise prefabricated components can be molded or embedded using the injection molding procedure.

The invention is not limited by the embodiments described above which are presented as examples only but can be modified in various ways within the scope of protection defined by the appended patent claims.

I claim:

1. A multiway connector for backplanes or slide-in cards for compact PCI systems, the connector comprising male and female multipoint connectors, each multipoint connector comprising at least two partial modules resting against each other at end faces thereof, wherein the partial modules of the male multipoint connector are comprised of a single-piece component of synthetic material and the partial modules of the female multipoint connector are comprised of a single-piece synthetic material component, and wherein each connector comprises a mechanical coding piece for preventing incorrect insertions.

2. The connector according to claim 1, wherein the male multipoint connector including the coding piece is comprised of a single-piece injection molded synthetic material component and the female multipoint connector and the coding piece are comprised of a single-piece injection molded synthetic material component.

3. The connector according to claim 1, wherein at least an upper side of each coding piece comprises a color coating for indicating the logic system being used.

4. The connector according to claim 2, wherein each single-piece injection molded synthetic material component is of a colored synthetic material for indicating the logic system being used.

5. The connector according to claim 1, wherein the male and female multipoint connectors and the coding pieces mounted thereon are of different or differently colored materials, and wherein each multipoint connector including the coding piece mounted thereon is comprised of a single-piece structural component.

* * * * *